US008967078B2

(12) United States Patent
Soucy et al.

(10) Patent No.: US 8,967,078 B2
(45) Date of Patent: Mar. 3, 2015

(54) ABRASIVE FINISH MASK AND METHOD OF POLISHING A COMPONENT

(75) Inventors: Ronald R. Soucy, Tolland, CT (US); Richard W. LaFranchise, Sturbridge, MA (US)

(73) Assignee: United Technologies Corporation, Hartford, CT (US)

( * ) Notice: Subject to any disclaimer, the term of this patent is extended or adjusted under 35 U.S.C. 154(b) by 1567 days.

(21) Appl. No.: 12/548,493

(22) Filed: Aug. 27, 2009

(65) Prior Publication Data

US 2011/0047777 A1 Mar. 3, 2011

(51) Int. Cl.

| | |
|---|---|
| ***B23P 11/00*** | (2006.01) |
| ***B23P 11/02*** | (2006.01) |
| ***B23P 17/00*** | (2006.01) |
| ***B21J 15/02*** | (2006.01) |
| ***B21D 53/78*** | (2006.01) |
| ***B05D 1/32*** | (2006.01) |
| ***B05D 3/12*** | (2006.01) |
| ***B24B 1/00*** | (2006.01) |
| ***B05C 11/11*** | (2006.01) |
| ***B24B 31/00*** | (2006.01) |
| ***B24B 31/12*** | (2006.01) |

(52) U.S. Cl.

CPC ..... *B24B 31/00* (2013.01); *B24B 31/12* (2013.01)

USPC ..... 118/504; 29/525.01; 29/451; 29/525.05; 29/889; 29/525.02; 427/282; 427/287; 451/29; 118/505

(58) Field of Classification Search

USPC ..... 451/29–31, 442; 29/451, 525.01, 29/525.05, 525.02, 458, 889; 427/282, 427/287, 448; 118/504, 505, 301, 721; 156/345.19

See application file for complete search history.

(56) References Cited

U.S. PATENT DOCUMENTS

| | | | | | |
|---|---|---|---|---|---|
| 2,292,031 | A | * | 8/1942 | Arnold | 174/31 R |
| 2,506,069 | A | * | 5/1950 | Dalton | 175/325.5 |
| 3,397,430 | A | * | 8/1968 | Pearl | 24/16 PB |
| 3,480,169 | A | * | 11/1969 | Hammes | 215/352 |
| 3,482,423 | A | * | 12/1969 | Smith et al. | 72/53 |
| 3,562,870 | A | * | 2/1971 | Sund | 24/16 PB |
| 4,066,269 | A | * | 1/1978 | Linne | 277/575 |
| 4,119,325 | A | * | 10/1978 | Oakley et al. | 277/642 |
| 4,384,822 | A | * | 5/1983 | Schweikl et al. | 415/137 |
| 4,401,367 | A | * | 8/1983 | Grantham et al. | 359/572 |
| 4,459,717 | A | * | 7/1984 | Halstead | 7/134 |
| 4,469,336 | A | * | 9/1984 | Linne | 277/402 |
| 4,512,859 | A | * | 4/1985 | Inoue | 205/662 |
| 4,530,861 | A | * | 7/1985 | Sippel et al. | 427/444 |
| 4,575,914 | A | * | 3/1986 | Armida et al. | 29/434 |
| 4,594,761 | A | * | 6/1986 | Murphy et al. | 29/889.71 |
| 4,688,805 | A | * | 8/1987 | Crotti et al. | 277/381 |
| 4,716,710 | A | * | 1/1988 | Galy et al. | 53/432 |

(Continued)

*Primary Examiner* — David Bryant
*Assistant Examiner* — Bayan Salone
(74) *Attorney, Agent, or Firm* — Carlson, Gaskey & Olds, P.C.

(57) ABSTRACT

A method of masking a component includes installing a flexible gasket over a portion of a component masking area leaving an unmasked area exposed. A backer is installed over the flexible gasket to compress the flexible gasket between the backer and the portion. The flexible gasket and the backer are secured to the component to provide an assembly. The assembly is deposited into a slurry with an abrasive media to polish the unmasked area, in one example. The flexible gasket and backer prevent abrasive media from reaching the masked area. The flexible gasket and backer can be removed from the component and reused on other similarly shaped components.

7 Claims, 2 Drawing Sheets

(56) References Cited

U.S. PATENT DOCUMENTS

| | | | | |
|---|---|---|---|---|
| 4,798,027 | A * | 1/1989 | Hamada | 451/29 |
| 5,341,602 | A * | 8/1994 | Foley | 451/64 |
| 5,343,609 | A * | 9/1994 | McManus | 29/451 |
| 5,390,997 | A * | 2/1995 | Nakaishi et al. | 305/103 |
| 5,437,724 | A * | 8/1995 | Dansereau et al. | 118/76 |
| 5,565,035 | A * | 10/1996 | Sylvestro et al. | 118/721 |
| 5,665,217 | A * | 9/1997 | Gruver et al. | 205/110 |
| 5,702,288 | A * | 12/1997 | Liebke et al. | 451/36 |
| 5,792,267 | A * | 8/1998 | Marszal et al. | 118/500 |
| 5,804,084 | A | 9/1998 | Nasby et al. | |
| 5,836,053 | A * | 11/1998 | Davignon et al. | 24/16 PB |
| 6,109,843 | A * | 8/2000 | Descoteaux | 409/134 |
| 6,109,873 | A * | 8/2000 | Brooks et al. | 416/62 |
| 6,177,038 | B1 * | 1/2001 | Reed et al. | 264/157 |
| 6,183,347 | B1 * | 2/2001 | Shaw | 451/36 |
| 6,235,987 | B1 * | 5/2001 | Gamaggio-Schafer | 174/40 CC |
| 6,247,895 | B1 * | 6/2001 | Brooks et al. | 416/62 |
| 6,273,676 | B1 * | 8/2001 | Brooks et al. | 415/191 |
| 6,332,926 | B1 * | 12/2001 | Pfaendtner et al. | 118/721 |
| 6,419,753 | B1 * | 7/2002 | Wheat et al. | 118/721 |
| 6,478,308 | B1 * | 11/2002 | McMillin et al. | 277/630 |
| 6,485,655 | B1 * | 11/2002 | Das et al. | 216/45 |
| 6,491,539 | B1 * | 12/2002 | Johnston | 439/373 |
| 6,520,838 | B1 * | 2/2003 | Shaw | 451/38 |
| 6,547,645 | B2 * | 4/2003 | Devine, II | 451/40 |
| 6,579,567 | B1 * | 6/2003 | Das et al. | 427/248.1 |
| 6,592,948 | B1 * | 7/2003 | Fusaro et al. | 427/448 |
| 6,645,299 | B2 * | 11/2003 | Brown | 118/505 |
| 6,699,402 | B2 * | 3/2004 | Russell et al. | 252/79.1 |
| 6,736,706 | B1 * | 5/2004 | Pan et al. | 451/99 |
| 6,780,089 | B2 * | 8/2004 | Pan et al. | 451/36 |
| 6,832,430 | B1 * | 12/2004 | Ogawa et al. | 29/460 |
| 6,863,927 | B2 * | 3/2005 | Langley et al. | 427/252 |
| 6,875,476 | B2 * | 4/2005 | Hawtin et al. | 427/448 |
| 6,913,442 | B2 * | 7/2005 | Das et al. | 415/210.1 |
| 7,066,799 | B2 * | 6/2006 | Oussaada et al. | 451/439 |
| 7,121,790 | B2 * | 10/2006 | Fokine et al. | 415/173.7 |
| 7,238,003 | B2 * | 7/2007 | Synnott et al. | 415/139 |
| 7,510,375 | B2 * | 3/2009 | Toppen et al. | 416/62 |
| 7,632,541 | B2 * | 12/2009 | Saylor et al. | 427/248.1 |
| 7,717,058 | B2 * | 5/2010 | Beck et al. | 118/504 |
| 7,753,648 | B2 * | 7/2010 | Evans et al. | 415/191 |
| 7,939,135 | B2 * | 5/2011 | Toppen et al. | 427/282 |
| 8,105,133 | B2 * | 1/2012 | Jayabalan | 451/442 |
| 8,173,218 | B2 * | 5/2012 | Mase et al. | 427/282 |
| 8,578,745 | B2 * | 11/2013 | Berndt et al. | 72/53 |
| 8,839,739 | B2 * | 9/2014 | Soucy et al. | 118/504 |
| 2001/0055650 | A1 * | 12/2001 | Pfaendtner et al. | 427/255.39 |
| 2002/0127097 | A1 * | 9/2002 | Darolia et al. | 415/137 |
| 2003/0027495 | A1 * | 2/2003 | Shaw | 451/29 |
| 2004/0072476 | A1 * | 4/2004 | Baier et al. | 439/874 |
| 2005/0227589 | A1 * | 10/2005 | Oussaada et al. | 451/29 |
| 2006/0113442 | A1 * | 6/2006 | Plate et al. | 248/228.1 |
| 2007/0110910 | A1 * | 5/2007 | Beck et al. | 427/421.1 |
| 2007/0240468 | A1 * | 10/2007 | Kalous | 70/432 |
| 2008/0241370 | A1 * | 10/2008 | Topa | 427/142 |
| 2008/0264444 | A1 * | 10/2008 | Minor et al. | 134/3 |
| 2009/0252872 | A1 * | 10/2009 | Saylor et al. | 427/248.1 |
| 2011/0020548 | A1 * | 1/2011 | Eichmann et al. | 427/282 |
| 2011/0297568 | A1 * | 12/2011 | Miller | 206/375 |
| 2012/0094580 | A1 * | 4/2012 | Jayabalan | 451/29 |
| 2014/0242278 | A1 * | 8/2014 | Hlavaty et al. | 427/282 |

* cited by examiner

ABRASIVE FINISH MASK AND METHOD OF POLISHING A COMPONENT

BACKGROUND

This disclosure relates to an abrasive finish mask. The disclosure also relates to a method of abrasively polishing a component.

Abrasive finishing or polishing is used to round off sharp edges and remove material from components. Various engine components in the aerospace industry, such as stator clusters, utilize abrasive polishing to improve the surface finish of the component. Typically, portions of the component must be masked to prevent undesired polishing or material removal on those portions to maintain desired dimensions. One method of component polishing includes depositing the masked component into a slurry containing abrasive media. The slurry is agitated in a manner that causes the abrasive media to remove material from unmasked areas of the component. Masked areas of the component are protected from the abrasive media and remain dimensionally unchanged.

Current masking techniques are labor and time intensive and, for example, apply a masking material that is adhered to the component. Quite often other processes are needed to clean the polished component to remove remnants left from the masking process, which is undesirable. Occasionally, process incidental damage may result when the masking is removed from the component.

SUMMARY

A mask for a component is disclosed that includes a flexible gasket having a first cavity with a shape configured to generally correspond to at least a portion of a contour of a component masking area. The flexible gasket has an outer surface. A backer, which is more rigid than the flexible gasket, includes a second cavity having an inner surface that generally corresponds to the outer surface. The inner surface is configured to be engageable with the outer surface in an installed condition and deflect the outer surface away from the inner surface to compress the flexible gasket between the inner surface and the portion.

A method of masking a component includes installing a flexible gasket over a portion of a component masking area leaving an unmasked area exposed. A backer is installed over the flexible gasket to compress the flexible gasket between the backer and the portion. The flexible gasket and the backer are secured to the component to provide an assembly. The assembly is deposited into a slurry with an abrasive media to polish the unmasked area, in one example. The flexible gasket and backer prevent abrasive media from reaching the masked area. The flexible gasket and backer can be removed from the component and reused on other similarly shaped components.

DETAILED DESCRIPTION

Figure 1:
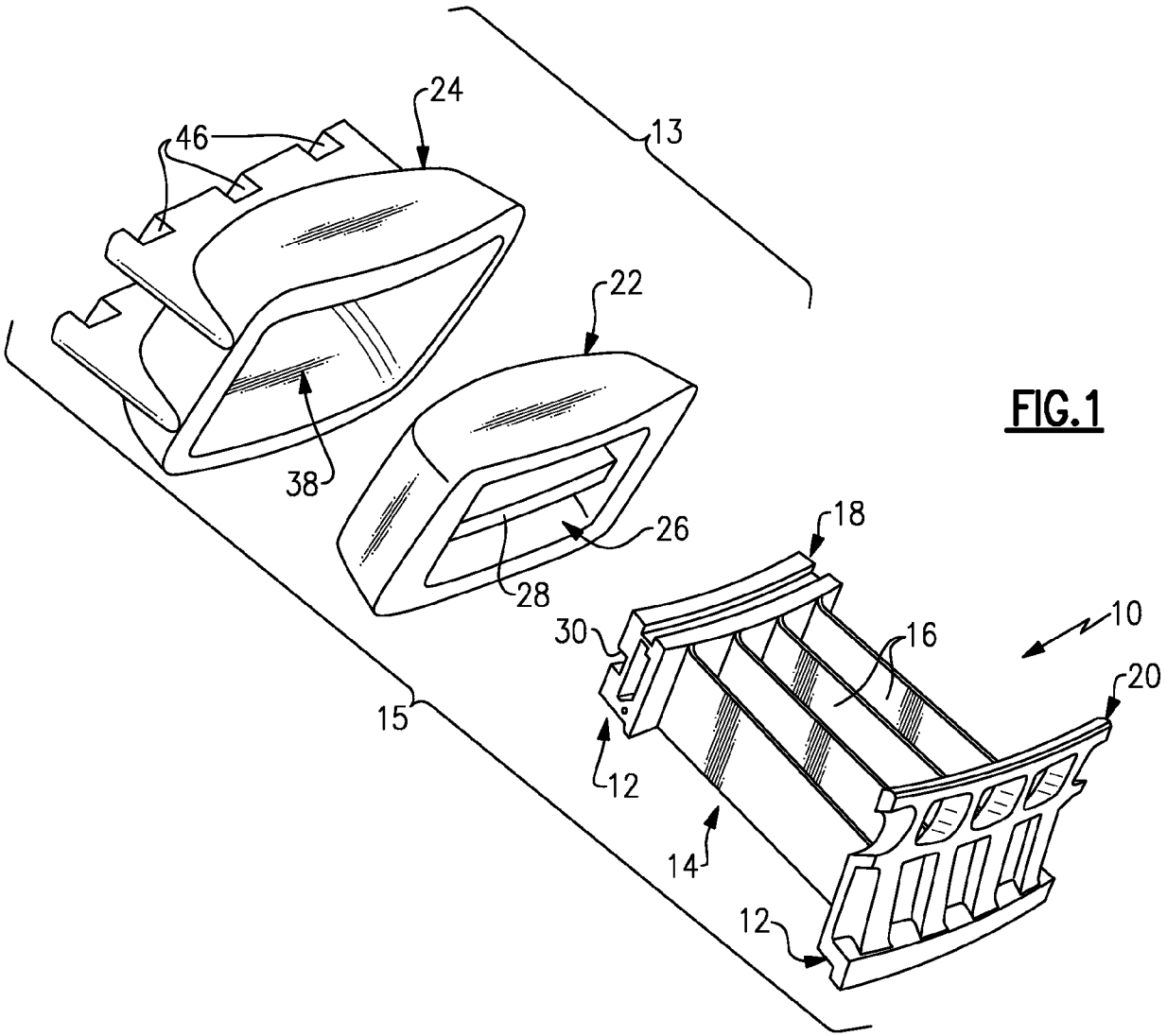
FIG. 1 is an exploded perspective view of an assembly including a mask according to the disclosure and a component to be polished.

FIG. 1 depicts a component in need of polishing. In the illustrated example, the component 10 is a stator cluster. The component 10 includes a masking area 12 and an unmasked area 14. The masking area 12 is a portion of the component 10 that is in need of masking or covering to prevent undesired material removal during an abrasive polishing process. The unmasked area 14 is a portion of the component in need of abrasive polishing to round-off sharp edges and remove material to improve surface finish in the unmasked area 14.

The example component 10 includes inner and outer ends 18, 20 in the masking area 12. Radially extending vanes 16 interconnect the inner and outer ends 18, 20 in the unmasked area 14. The vanes 16 are polished during the abrasive polishing process to improve the aerodynamic surface finish of the vane 16, which are arranged in the flow path of a gas turbine engine.

Figure 3:
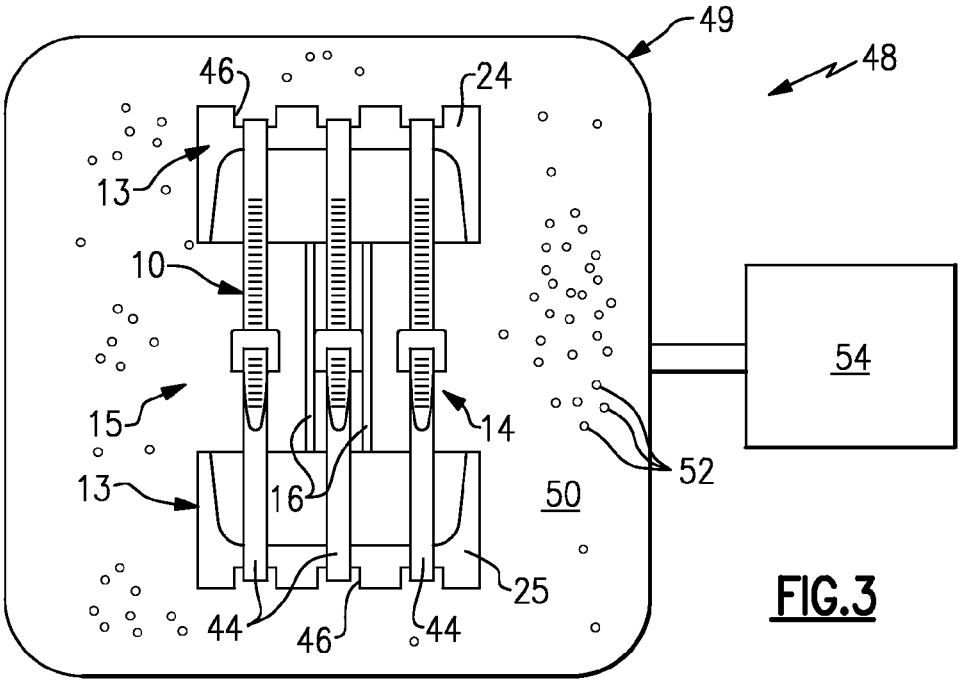
FIG. 3 is a schematic view of the assembly in a polishing machine.

A reusable mask 13 is removably installed onto each of the inner and outer ends 18, 20 to cover the masking area 12. The masks 13 are secured about the component 10 to provide an assembly 15 that can be deposited into a polishing machine 48 having abrasive media 52 (FIG. 3). In the disclosed example, the mask 13 includes a flexible gasket 22 and a backer 24 that is more rigid than the flexible gasket 22. In one example, the flexible gasket 22 is constructed from a silicone material, for example, using a mold. The backer 24 is constructed from a relatively rigid nylon, for example, using a selective laser sintering process. In the example, the flexible gasket 22 and backer 24 are constructed from different materials, although they may be constructed from generally the same material with different rigidities.

The flexible gasket 22 includes a cavity 26 that receives the inner end 18. The cavity 26 includes a locating feature 28 that cooperates with a complementary feature on the inner end 18, such as a slot 30 in an installed position. An opening 31 adjoins the cavity 26.

Figure 2B:
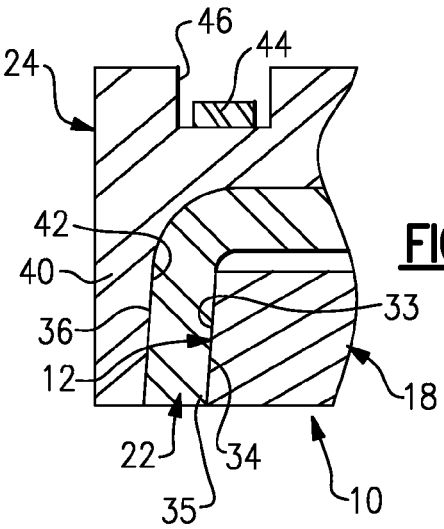
FIG. 2B is a partial cross-sectional view of the mask installed and retained onto the component.
Figure 2A:
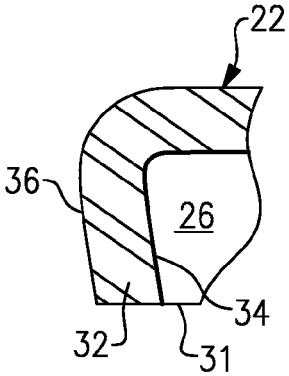
FIG. 2A is a partial cross-sectional view of an example gasket.

Referring to FIGS. 2A and 2B, the flexible gasket 22 includes a wall 32 having inner and outer surfaces 34, 36 spaced from one another. The cavity 38 is of a slightly smaller dimension than the inner end 18 to ensure an interference fit between the flexible gasket 22 and the inner end 18 so that abrasive media 52 does not penetrate the masking area 12.

In one example, the inner and outer surfaces 34, 36 are canted at an approximately 10° angle toward the opening 31 in an uninstalled position (FIG. 2A) relative to an adjoining surface 33 of the inner end 18 with the component 10 installed into the flexible gasket 22. In the example, the inner end 18 is inserted through the opening 31 into the cavity 26. Thus, the opening 31 to the cavity 26 is smaller than a perimeter 35 of the inner end 18 where the flexible gasket 22 seals against the inner end 18 in the installed position (FIG. 2B). The backer 24 includes a cavity 38 that is sized slightly smaller than the outer surface 36 of the flexible gasket 22 to ensure that the flexible gasket 22 firmly engages and deflects the perimeter of the inner end 18. In the example, the backer 24 includes a wall 40 having an inner surface 42 that engages the outer surface 36 of the flexible gasket 22 away from the inner surface 42 in the installed position. In this manner, the backer 24 compresses the flexible gasket 22, between the backer 24 and component 10 and applies uniform pressure to the flexible gasket 22 around at least the perimeter 35 to prevent abrasive media from reaching the masked area 12.

Another backer 25 and flexible gasket is installed onto the outer end 20 in a manner similar to that described above relative to the inner end 18.

Referring to FIGS. 2B and 3, the backers 24, 25 include one or more notches 46 on a side opposite the cavity 38 for locating retainers 44 that maintain the masks 13 tightly about the component 10 during polishing. In one example, the retainers 44 are zip or cable ties. The retainers 44 are tightened until the masking area 12 is fully received within the cavities 26 of the flexible gaskets 22 so that abrasive media 52 will not penetrate the masking area 12.

The assembly 15 is deposited into a polishing machine 48. The polishing machine 48 includes a tank 49 filled with a slurry 50 having abrasive media 52. A vibratory device 54 agitates the slurry 50 causing the abrasive media 52 to remove and polish material from the unmasked area 14. The masks 13 at the ends 18, 20 of the component 10 seal out the abrasive media 52 from the masking area 12 on the component 10. The zip ties are cut to remove the flexible gaskets 22 and backers 24, 25 from the component 10. The flexible gaskets 22 and backers 24, 25 can be reused with other similarly shaped components.

Although example embodiments have been disclosed, a worker of ordinary skill in this art would recognize that certain modifications would come within the scope of the claims. For that reason, the following claims should be studied to determine their true scope and content.

What is claimed is:

1. A mask for a component comprising:

a flexible gasket having a first cavity with a shape configured to generally correspond to at least a portion of a contour of a component masking area, the flexible gasket having an outer surface;

a backer that is more rigid than the flexible gasket, the backer including a second cavity having an inner surface that generally corresponds to the outer surface, the inner surface configured to be engageable with the outer surface in an installed condition and to deflect the outer surface away from the inner surface; and a retainer engageable with the backer and configured to secure the backer and flexible gasket to the component.

2. The mask according to claim 1, wherein the flexible gasket includes a silicone material.

3. The mask according to claim 1, wherein the backer includes a nylon material.

4. The mask according to claim 1, wherein the backer includes a notch configured to receive the retainer.

5. The mask according to claim 4, wherein the retainer is a zip tie.

6. The mask according to claim 1, wherein the backer includes a notch on a side opposite the second cavity.

7. The mask according to claim 1, wherein the shape includes a locating feature configured to cooperate with a complementary feature of the component.

* * * * *